US006427405B1

(12) United States Patent
Moriya et al.

(10) Patent No.: US 6,427,405 B1
(45) Date of Patent: Aug. 6, 2002

(54) JOINT MATERIAL AND EXECUTION METHOD THEREOF

(75) Inventors: Mamoru Moriya; Kenichi Hasagawa, both of Tokyo (JP)

(73) Assignee: Seiki Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/674,494

(22) PCT Filed: Mar. 12, 1999

(86) PCT No.: PCT/JP99/01201

§ 371 (c)(1),
(2), (4) Date: Nov. 13, 2000

(87) PCT Pub. No.: WO00/55443

PCT Pub. Date: Sep. 21, 2000

(51) Int. Cl.[7] ..... E04B 1/68

(52) U.S. Cl. ..... 52/396.04; 52/396.05; 52/396.08; 52/396.06; 52/471; 52/741.4

(58) Field of Search ..... 52/396.04, 396.05, 52/312, 396.06, 396.07, 396.08, 366, 374, 471, 514.5, 741.4; 277/316, 630, 645, 637, 650, 542, 906, 935; 404/47, 49, 69

(56) References Cited

U.S. PATENT DOCUMENTS

| | | | | | |
|---|---|---|---|---|---|
| 1,546,736 | A | * | 7/1925 | Krause | 52/396 |
| 3,604,169 | A | * | 9/1971 | Smith | 52/396 |
| 4,285,612 | A | * | 8/1981 | Betti | 404/68 |
| 4,362,427 | A | * | 12/1982 | Mass et al. | 404/64 |
| 4,884,381 | A | * | 12/1989 | Betti | 52/741 |
| 5,155,952 | A | * | 10/1992 | Herwegh et al. | 52/100 |

FOREIGN PATENT DOCUMENTS

| | | |
|---|---|---|
| JP | 52-062937 | 5/1977 |
| JP | 6-240772 | 8/1994 |
| JP | 9-032135 | 2/1997 |
| JP | 2583575 | 8/1998 |
| JP | 10-292505 | 11/1998 |

* cited by examiner

*Primary Examiner*—Carl D. Friedman
*Assistant Examiner*—Phi Dieu Tran A
(74) *Attorney, Agent, or Firm*—Oblon, Spivak, McClelland, Maier & Neustadt, P.C.

(57) ABSTRACT

A joint member is provided that can be easily installed, without sacrificing an appearance, in a joint groove required to secure water-tightness between adjoining wall surface facing members of a building. A joint base member 6 is integrally and consecutively installed on a surface of a synthetic resin joiner 4 positioned and provided between wall surface facing members A. The joint base member 6 has right and left side plates 12, two soft sealing tongue flaps 14*a* and 14*b* which are protuberantly provided on the outer side surfaces of the side plates and the distal ends of which come in contact with end surfaces of the wall surface facing members, and numerous apertures 16 drilled between the sealing tongue flaps, a sealant 8 being charged in a gap between the side plates. A core member 10 pushed into the gap between the side plates 12 of the joint base member is formed by consecutively installing a core portion 10A for pushing out the sealant 8 through the apertures by being pushed into the gap between the side plates 12, and a jaw plate of a head portion 10B that covers a mouth portion of a joint groove. The core portion 10A has a length that does not cause itself to reach a bottom portion of a sealant charge area S3 between the side plates 12 when the core portion 10A is pushed in.

8 Claims, 6 Drawing Sheets

JOINT MATERIAL AND EXECUTION METHOD THEREOF

BACKGROUND OF THE INVENTION

1. Field of the Invention

The present invention relates to a joint member for a joint groove required to secure water-tightness between adjacent wall surface facing members in a building, and an installation method for the same.

2. Discussion of the Background

Hitherto, as a means for sealing a joint groove between adjacent wall surface facing members A of a siding or the like in a building, a hat-shaped joiner 50 shown in FIG. 11 is fixed to a bed member 51 such as a furring strip, and a sealant 52 is charged in a joint groove formed by abutting the wall surface facing members A against both side surfaces 50*a* of a protuberance of the joiner 50 so as to enhance the water-tightness of the joint groove.

The conventional means for sealing a joint groove, however, requires that masking be provided before installation to prevent a sealant from adhering to the wall surface facing members A prior to charging the sealant 52. The installation is not only cumbersome but also requires skill because the surface of the sealant 52 must be made as flat as possible in order not to ruin an appearance thereof. Furthermore, spots are produced in some cases when charging the sealant, so that sealing effect cannot always be enhanced.

SUMMARY OF THE INVENTION

A technological object of the present invention is to provide a joint member that can be easily installed, without adversely affecting an appearance, in a joint groove required to secure water-tightness between adjoining wall surface facing members of a building, and an installation method for the same.

Another technological object of the present invention is to provide a joint member and an installation method for the same that permit easy, reliable sealing in setting a predetermined joint groove between wall surface facings by using a joiner, by providing the joiner itself with a structure for enabling a joint groove to be easily sealed so as to obviate the need for masking or manual sealant charging.

To these ends, a first joint member in accordance with the present invention is comprised of: a joint base member consecutively and integrally installed on a surface of a synthetic resin joiner provided by being positioned between wall surface facing members on a bed surface of a building facing; wherein the joint base member has right and left side plates, at least two soft sealing tongue flaps protuberantly provided on outer side surfaces of the side plates, distal ends thereof being in contact with end surfaces of the wall surface facing members that constitute inner walls of a joint groove, and many apertures drilled between the sealing tongue flaps in the two side plates; a sealant of a sufficient amount to be pressed out and charged into a space to seal the space surrounded by the pair of sealing tongue flaps and the inner side walls of the joint groove is charged between the side plates of the joint base member; and a sealing member for restraining outflow of the sealant is attached to a mouth portion between the two side plates of the joint base member; and a core member to be pushed into a gap between the side plates of the joint base member is formed by a core portion that pushes into the gap between the side plates while pressing the covering member thereby to press the sealant, which has been charged therein, out through the apertures of the side plates, and a jaw plate of a head portion that covers a joint groove mouth portion, the core portion and the jaw plate being consecutively installed such that they are formed to have a substantially T-shaped section, and the core portion having a length that does not cause itself to reach a bottom part of a sealant charge area between the sides plates when it is pushed in.

Further, a second joint member in accordance with the present invention is comprised of: a joint base member consecutively and integrally installed on a surface of a synthetic resin joiner provided by being positioned between wall surface facing members on a bed surface of a building facing; wherein the joint base member has right and left side plates, at least two soft sealing tongue flaps protuberantly provided on outer side surfaces of the side plates, distal ends thereof being in contact with end surfaces of the wall surface facing members that constitute inner walls of a joint groove, and many apertures drilled between the sealing tongue flaps in the two side plates; a sealant of a sufficient amount to be pressed out and charged into a space to seal the space surrounded by the pair of sealing tongue flaps and the inner side walls of the joint groove is charged between the side plates of the joint base member; and a covering member for restraining outflow of the sealant and for restraining a mouth portion between the two side plates from narrowing is fitted into the mouth portion between the two side plates of the joint base member; and a core member to be pushed into a gap between the side plates of the joint base member is formed by a core portion that presses out the sealant, which has been charged by being pushed into the space between the side plates, out through the apertures of the side plates by pressing the covering member to push it into the gap between the side plates, and a jaw plate of a head portion that covers a joint groove mouth portion, the core portion and the jaw plate being consecutively installed so that they are formed to have a substantially T-shaped section, and the core portion having a length that does not cause a distal end of the covering member to reach a bottom part of a sealant charge area between the sides plates when the core portion is pushed in.

In the joint member, it is appropriate to form, between sealing tongue flaps on the joiner side in the side plates of the joint base member and the joiner, a space into which the remainder of the sealant, which is pressed into the space surrounded by the pair of sealing tongue flaps and the inner walls of the joint groove when the core member is pushed into a gap between the side plates, flows. Furthermore, it is preferable to form a protuberance for setting a minimum width of the joint groove on the proximal ends of at least one set of sealing tongue flaps at opposing positions of the two side plates, the protuberance being located on outer side surfaces of the two side plates in the joint base member.

Furthermore, an installation method in accordance with the present invention employing the aforesaid joint member is comprised of: a step for providing a joiner by positioning a joint base member between wall surface facing members on a bed surface of a building facing; and a step for pushing a core portion of a core member into a gap between side plates of the joint base member filled with a sealant, or pushing in the core portion of the core member while pushing a covering member, which has been fitted into a mouth portion between the two side plates of the joint base member, to push the sealant out through apertures in the side plates into a space surrounded by a pair of sealing tongue flaps protuberantly provided on the outer side surfaces of the side plates and inner walls of a joint groove, and covering a mouth portion of the joint groove by a jaw plate of a core member head portion at the same time.

Furthermore, a third joint member in accordance with the present invention is comprised of: a sealing structural member integrally and consecutively installed on a surface of a synthetic resin joiner provided and positioned between wall surface facing members on a bed surface of a building facing; wherein the sealing structural member has flexible right and left side plates and soft sealing flaps protuberantly provided on outer side surfaces of the side plates; a core member pushed into a gap between the side plates of the sealing structural member is formed by a core portion that is pushed into a gap between the side plates to push and spread the two side plates to press the sealing flaps on outer side surfaces of the side plates into contact with inner walls of a joint groove, and a jaw plate of a head portion for sealing a mouth portion of the joint groove, the core portion and the jaw plate being consecutively installed to have a substantially T-shaped section; and engaging portions, which engage with each other when a core member is pushed into the sealing structural member so as to hold the core member between the two side plates in the sealing structural member so that it does not slip off, are provided inside the two side plates in the sealing structural member and on the core portion of the core member.

The sealing flaps protuberantly provided on the outer side surfaces of the two side plates in the sealing structural member of the third joint member may be formed by a plurality of soft sealing tongue flaps made integral with the side plates.

Furthermore, the engagement between the side plates and the core portion in the core member may be accomplished by engaging a proximal end portion or a distal end portion of the core portion with an engaging portion of an associated side plate.

The following will explain more specifically about the aforesaid joint member and its installation method. To set the joint member in accordance with the present invention in a joint groove between adjoining wall surface facing members in a building, first, a joiner is provided with the joint base member positioned between the wall surface facing members on a bed surface of a building facing. At this time, the sealing tongue flaps are in elastic and close contact with the end surfaces of the wall surface facing members so as not to produce a clearance between the wall surface facing members and the joint base member. Especially when the proximal end portions of at least one set of the sealing tongue flaps are provided with protuberances in the positions where the two side plates of the joint base member oppose each other, the joint groove of the wall surface facing members can be set to a minimum width by the protuberances.

As described above, when providing the joiner with the joint base member positioned between the wall surface facing members, the sealing tongue flaps protuberantly provided on the outer side surfaces of the two side plates in the joint base member are pressed against the inner walls of the joint groove. There is a danger in that the gap between the side plates reduces due to a reaction force received from the inner walls of the joint groove, causing the sealant to flow out through the mouth between the two side plates. This problem can be solved by increasing the strength of the bottom plate portions of the two side plates in the joiner. Narrowing of the mouth of the two side plates can be restrained by fitting a covering member into the mouth between both side plates in the joint base member.

Thereafter, the core portion of the core member is pushed into a gap between the two side plates of the joint base member to push the sealant out of the apertures drilled in the side plates of the joint base member. The sealant is charged in the space surrounded by the pair of sealing tongue flaps and the inner walls of the joint groove, and the remaining sealant pushes and spreads the sealing tongue flap on the joiner side of the side plate in the joint base member to flow into the space between the joiner and the sealing tongue flap. This arrangement prevents the sealant from spreading out of the joint member due to variations in the width of the joint groove.

To be more specific, the upper surfaces of the sealing tongue flaps come in close contact with the inner walls of the joint groove so that the sealing tongue flaps bend toward the joiner when the end surfaces of the wall surface facing members are pressed into contact. Hence, even if the sealant which has been pushed out fails to be accommodated between the pairs of sealing tongue flaps, the sealant will flow out into the space on the side of the joiner through the gap between the sealing tongue flaps on the side of the joiner and the inner walls of the joint groove, so that it will not flow out of the wall surface facing members through a gap between the sealing tongue flaps on the mouth of the two side plates in the joint base member that is difficult to push and spread by curving and the inner walls of the joint groove. This arrangement enables the sealant to be effectively used for sealing the joint grooves and also permits variations in the width of joint grooves to be successfully handled.

Thus, the first and second joint members described above make it possible to easily install a joint member in a joint groove required to secure water-tightness between adjoining wall surface facing members of a building without adversely affecting an appearance thereof.

Moreover, since the joiner itself is provided with the structure for easily sealing a joint groove, the need for masking or manual charging of a sealant can be obviated, permitting easy, reliable sealing.

In addition, an area for accommodating an extra sealant to cope with variations in the width of a joint groove is secured, preventing the sealant from extending out of the joint member when the core member is pushed in. This arrangement enables effective use of the sealant for sealing the joint groove thereby to provide effective sealing between the joint groove and the inner walls.

Thus, according to the present invention, a joint member can be easily installed, without sacrificing an appearance, in a joint groove required to secure water-tightness between adjoining wall surface facing members of a building. Moreover, since the joiner itself is provided with the structure for easily sealing a joint groove, the need for masking or manual charging of a sealant can be obviated, permitting easy, reliable sealing.

In addition, an area for accommodating an extra sealant to cope with variations in joint grooves is secured, preventing the sealant from extending out of the joint member when the core member is pushed in. This arrangement enables effective use of the sealant for sealing the joint groove thereby to provide effective sealing between the inner walls of the joint groove.

To install the third joint member described above, first, the sealing structural member is positioned between the wall surface facing members, and a joiner is provided in place. Under this condition, the wall surface facing members are fixed, then the core portion of the core member is pushed into a gap between the two side plates of the sealing structural member. This causes the jaw plate of the core member head portion to primarily seal a mouth portion of the joint groove, and at the same time, the two side plates of the sealing structural member are pushed and spread, causing the sealing flaps on the outer side surfaces of the side plates to be pressed into contact with the inner walls of the joint groove to perform secondary sealing. Furthermore, the engaging portions provided in the two side plates in the sealing structural member and the core portion in the core member engage with each other to hold the core member between the two side plates in the sealing structural member so that it does not slip off. This arrangement makes it possible to positively maintain water-tightness and also to accommodate variations in the width of joint grooves.

Thus, a joint member can be provided that can be easily installed in a dry manner, without sacrificing an appearance, in a joint groove required to secure water-tightness between adjacent wall surface facing members of a building.

In addition, the joiner itself is provided with the structure for easily sealing a joint groove and is adapted to obviate the need for a wet type sealant. Hence, there is no need for masking or manual charging of a sealant, thus permitting reliable sealing to be achieved easily at low cost.

DESCRIPTION OF THE PREFERRED EMBODIMENTS

The following will describe embodiments of a joint member in accordance with the present invention in detail with reference to the accompanying drawings. FIG. 1 through FIG. 4 show a first embodiment of a joint member in accordance with the present invention.

Figure 1:
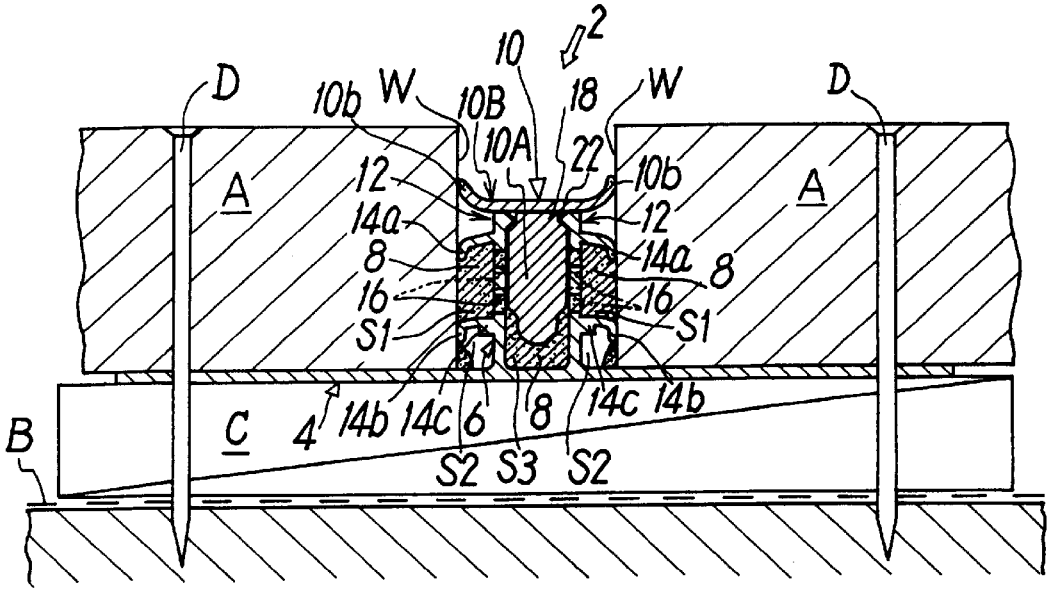
FIG. 1 a sectional view showing a state of a joint member of a first embodiment in accordance with the present invention after installation.

In FIG. 1, reference numeral 2 denotes a joint member for sealing a joint groove at joined portion or the like of a wall surface facing member (a siding or other facing panel) A of a building. The joint member 2 is used primarily for a joint groove required to secure water-tightness between adjoining wall surface facing members A in the building. The joint member 2 is schematically formed of a joiner 4, a joint base member 6 made integral with the joiner 4, a sealant 8, and a core member 10.

As can be seen from FIG. 1, the joiner 4 is positioned and provided between adjoining wall surface facing members A on a furring strip C. The furring strip C, which constitute a bed surface of facing, is installed to a body of the building via a waterproof sheet B employed as necessary. The joiner is then fixed to the furring strip C together with the wall surface facing members A by nails D or the like, enabling the wall surface facing members A to be installed consecutively.

Figure 2:
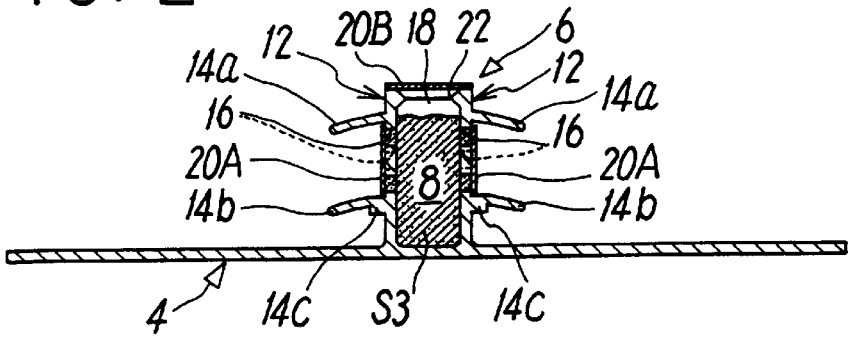
FIG. 2 is a sectional view showing a state wherein a sealant has been charged in a joint base member provided integrally and consecutively with a joiner of the first embodiment.
Figure 3:
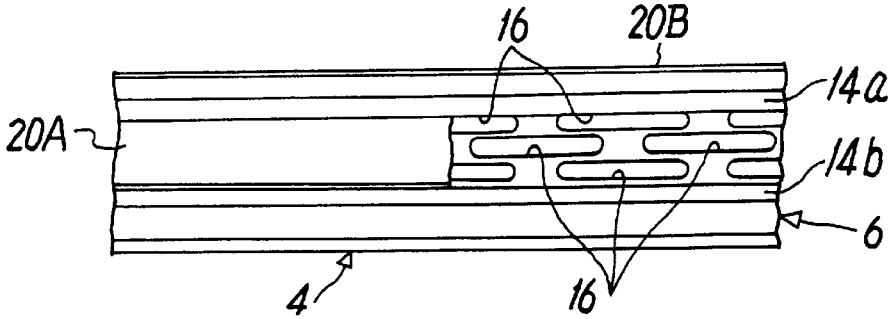
FIG. 3 is a side view of the state shown in FIG. 2.

The joint base member 6 consecutively and integrally installed to the surface of the joiner 4 has its right and left side plates 12 and 12 made of a relatively hard synthetic resin consecutively installed to the joiner 4 at their proximal ends such that it is formed to have a substantially U-shaped section as clearly shown in FIG. 2 and FIG. 3. A pair of sealing tongue flaps 14*a* and another pair of sealing tongue flaps 14*b*, which are made of a soft synthetic resin, are protuberantly provided aslant downward at upper and lower positions, respectively, on the outer side surfaces of the respective side plates 12 such that they are formed integrally with the side plates 12. Protuberances 14*c* and 14*c* for setting a minimum width of a joint groove are provided on the proximal portions of the pair of sealing tongue flaps 14*b* and 14*b* at positions near the joiner 4 where they oppose each other in the joint base member 6.

A sealant 8 having fluidity and viscosity is charged in a space between the two side plates 12 and 12. Numerous apertures 16, through which the sealant 8 is pushed out into a space S1 surrounded by the pairs of sealing tongue flaps 14*a* and 14*b* and an inner wall W of the joint groove as the core member 10 is pushed into the gap between the side plates 12 and 12, are provided at equal intervals in the lengthwise direction of the joint base member 6 and in a plurality of rows between the sealing tongue flaps 14*a* and 14*b* in the two side plates 12. In adjacent aperture rows, each of the apertures 16 is disposed so that it is positioned between two adjacent apertures 16 and also partly overlaps the apertures 16 in adjoining rows. This allows the sealant 8 to be pushed out substantially uniformly in the longitudinal direction of the joint base member 6.

Furthermore, a space S2 is formed between the sealing tongue flaps 14*b* facing the joiner 4 and the joiner 4 in the joint base member 6 as illustrated in FIG. 1. When the core member 10 is pushed into a mouth portion 18 between the two side plates 12 and 12 in the joint base member 6, if the sealant 8 charged in the space S1 surrounded by the pairs of sealing tongue flaps 14*a* and 14*b* and the inner walls W of the joint groove leaves a remainder due to a width of the joint groove, then the remainder pushes and spreads the sealing tongues flaps 14*a* facing the joiner 4 to flow into the space S2.

The sealant 8 in an appropriate amount for a relatively large width of a joint groove, i.e. an amount that is sufficient to be pushed out and charged in the space S1 surrounded by the pairs of sealing tongue flaps 14*a* and 14*b* and the inner walls W of the joint groove so as to seal the space, is charged between the two side plates 12 and 12 in the joint base member 6. The sealant 8 is formed of isobutylene-isoprene rubber or a silicone resin or other rubber type or synthetic resin type elastomer, and it is required to exhibit fluidity and viscosity so that it may be pushed out of the apertures 16 of the side plates 12 when the core member 10 is pushed into the space between the two side plates 12 and 12 in the joint base member 6.

Mold release sheets 20A covering the apertures 16 of the two side plates 12 and 12 are attached beforehand to the joint base member 6 into which the sealant 8 is charged. After the charging, a mold release sheet 20B for inhibiting outflow of the sealant 8 is attached to the mouth portion 18 between the two side plates 12 and 12, the mouth portion 18 opening at the top of the joint base member 6. It may be unnecessary to attach the mold release sheet 20A if the apertures 16 are small and there is no danger of leakage of the sealant.

Figure 4:
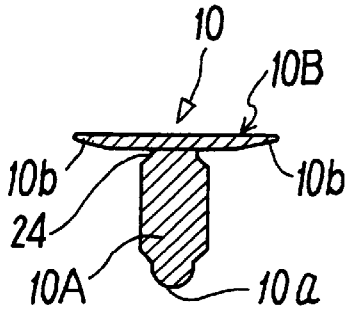
FIG. 4 is a sectional view of a core member of the first embodiment.

As shown in FIG. 1 and FIG. 4, the core member 10 is formed to have a substantially T-shaped section by consecutively installing a core portion 10A formed of a relatively hard synthetic resin and a jaw plate of a head portion 10B that covers the mouth of the joint groove. The core portion 10A is formed to be a plate substantially as thick as the width between the two side plates 12 and 12 in the joint base member 6, a distal end 10*a* thereof being formed to be round to ensure smooth insertion of the core member 10 into a gap between the side plates 12 and 12 and smooth flow of the sealant 8. Furthermore, the core portion 10A is formed to have a length such that it does not reach a bottom portion of a sealant charge area S3 between the side plates 12, and also formed so that the sealant 8 pushed out into the space S1 surrounded by the pairs of sealing tongue flaps 14*a* and 14*b* and the inner wall W of the joint groove is spread and merged between the distal end of the core portion 10A and the bottom portion of the sealant charge area S3 between the side plates 12 thereby to maintain reliable sealing. Furthermore, the head portion 10B of the core member 10 has its both wings 10*b* in frictional contact with the inner walls W of the joint groove, and it is formed of a jaw plate made of a relatively soft synthetic resin that covers the mouth portion of the joint groove.

The mouth edge portions of the inner surfaces of the two side plates 12 and 12 in the joint base member 6, and the proximal portions of the two side surfaces of the core portion 10A in the core member 10 are provided with engaging portions 22 and 24, respectively, that engage with each other when the core portion 10A is pushed into a gap between the two side plates 12 and 12 of the joint base member 6.

The following will describe in further detail the joint member 2 and its installation method. To install the joint member 2 between the adjacent wall surface facing members A in a building, the mold release sheets 20A are first peeled off from the outer side surfaces of the two side plates 12 in the joint base member 6. Then, as illustrated in FIG. 1, the joiner 4 is provided on the furring strip C installed on a building facing via the waterproof sheet B, with the joint base member 6 positioned between the adjoining wall surface facing members A. At this time, the sealing tongue flaps 14*a* and 14*b* are brought into elastic contact with the end surfaces of the wall surface facing members A such that no more gap than necessary is allowed between the wall surface facing members A and the joint base member 6. In this case, it is desirable to retain the end surfaces of the wall surface facing members A in such positions that they do not come in contact with the protuberances 14*c* and 14*c* formed on the proximal portions of the pair of sealing tongue flaps 14*b* and 14*b* in the two side plates 12 of the joint base member 6 since the protuberances 14*c* and 14*c* function to set the minimum width of a joint groove formed by the end surfaces of the wall surface facing members A.

It is alternatively possible to separately provide the joiner 4 with abutting surfaces to be abutted against the end surfaces of the wall surface facing members A to set the width of a joint groove.

Thereafter, as the core portion 10A of the core member 10 is pushed into a gap between the two side plates 12 of the joint base member 6, the sealant 8 is pushed out of the apertures 16 drilled in the side plates 12 of the joint base member 6, causing the sealant 8 to be charged in the space S1 surrounded by the pairs of sealing tongue flaps 14*a* and 14*b* and the inner walls W of the joint groove. If the sealant 8 leaves a remainder, then the remainder pushes and spreads the sealing tongue flaps 14*b* facing the joiner 4 of the side plates 12 in the joint base member 6 to flow into the space S2 between the joiner 4 and the sealing tongue flaps 14*b*. This arrangement prevents the sealant 8 from spreading out of the joint member 2 due to variations in the width of joint grooves. The core member 10 is pushed in until the engaging portions 24 in the core portion 10A engage the engaging portions 22 of the two side plates 12 and 12 in the joint base member 6. The engagement between the engaging portions 22 and 24 retains the core member 10 in a predetermined push-in position.

More specifically, when the end surfaces of the wall surface facing members A are pressed into contact, the upper surfaces of the sealing tongue flaps 14*a* and 14*b* are brought into close contact with the inner walls W of the joint groove such that they are bent toward the joiner 4. Hence, even if the sealant 8, which has been pushed out, cannot be completely accommodated in the space S1 between the pairs of the sealing tongue flaps 14*a* and 14*b*, the sealant 8 will flow out into the space S2 on the side of the joiner 4 through the gap between the sealing tongue flaps 14*b* on the side of the joiner 4 and the inner walls W of the joint groove, so that it will not flow out of the wall surface facing members A through a gap between the sealing tongue flaps 14*a* on the mouth portion of the two side plates 12 in the joint base member 6 that is difficult to push and spread by curving and the inner walls W of the joint groove. This arrangement enables the sealant 8 to be effectively used for sealing joint grooves and also successfully accommodates variations in the width of joint grooves. If less sealant flows out from the space S1, then the sealing tongue flaps 14*a* and 14*b* may be slanted upward in advance so as to allow the sealant to flow out into a gap between the sealing tongue flaps 14*a* and the jaw plate of the core member head portion 10B.

The joint member described above can be easily installed, without sacrificing an appearance, in a joint groove required to secure water-tightness between adjoining wall surface facing members A of a building. Moreover, since the joiner 4 itself is integrally provided with a joint base member 6 filled with the sealant 8 for easily sealing a joint groove, the need for masking or manual charging of the sealant 8 can be obviated, permitting easy, reliable sealing. Moreover, the area for accommodating an extra sealant 8 to cope with variations in the widths of joint grooves is secured, preventing the sealant 8 from extending out of the joint member 2 when the core member 10 is pushed in. This arrangement enables effective use of the sealant 8 for sealing the joint groove thereby to provide effective sealing between the inner walls W of the joint groove.

Figure 5:
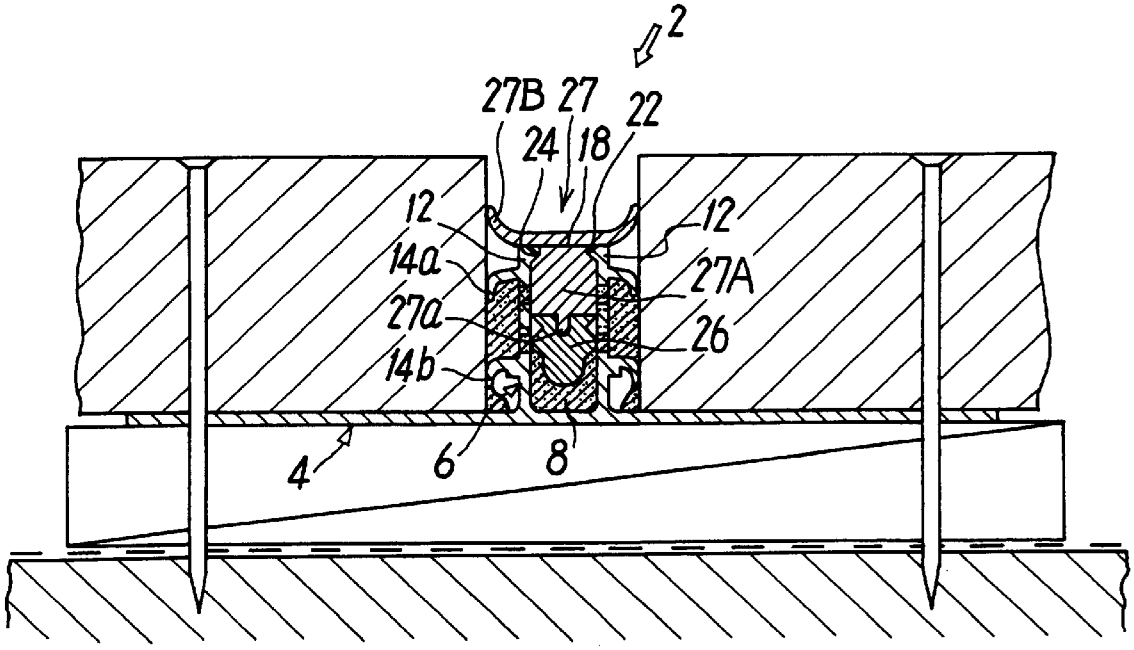
FIG. 5 is a sectional view showing a state of a joint member of a second embodiment in accordance with the present invention after installation.
Figure 6:
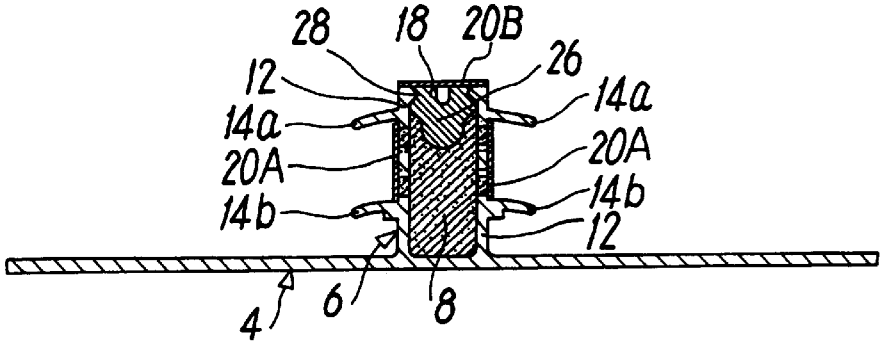
FIG. 6 is a sectional view showing a state wherein a sealant has been charged in a joint base member provided integrally and consecutively with a joiner of the second embodiment.
Figure 7:
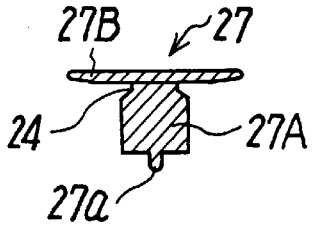
FIG. 7 is a sectional view of a core member of the second embodiment.

FIG. 5 through FIG. 7 illustrate a second embodiment of the present invention. A joint member 2 of the second embodiment has a covering member 26 fitted in a mouth portion 18 between two side plates 12 in a joint base member 6 filled with a sealant 8 as clearly shown in FIG. 6. Prior to installation of the joint member 2, the covering member 26 is retained at the mouth portion 18 between the two side plates 12 in the joint base member 6 by an engagement between engaging portions 28 formed on both side surfaces thereof and engaging portions 22 formed on a mouth edge of the inner side surfaces of the two side plates 12 in the joint base member 6. The covering member 26 inhibits the sealant 8 from flowing out through the mouth portion 18 between the two side plates 12 in the joint base member 6, and also inhibits the mouth portion between the two side plates from being narrowed by the two side plates being pushed inward with consequent outflow of the sealant or interference with the core member being pushed in. It is also possible to attach a mold release sheet 20B, which is for inhibiting the sealant 8 from flowing out, onto the covering member 26.

When providing the covering member 26, a head portion 27B of a core member 27 identical to that in the first embodiment is used, and a core portion 27A of the core member 27 is formed to have a length so that the distal end of the covering member 26 does not reach the bottom portion of the sealant charge area between the side plates 12 when the core portion 27A is pushed in. The distal end of the core portion 27A is provided with a protuberance 27*a* that engages a recess formed in the covering member 26 to stabilize the connection therebetween.

The rest of the configuration and operation of the joint member of the second embodiment are substantially identical to those of the first embodiment; therefore, like reference numerals will be assigned to like or equivalent components, and the descriptions thereof will be omitted. The method for installing the joint member of the second embodiment is the same as that of the first embodiment except that the core portion 27A of the core member 27 is pushed into a gap between the two side plates 12 of the joint base member 6 filled with the sealant 8 while pushing the covering member 26 fitted into the mouth portion between the two side plates 12.

Figure 8:
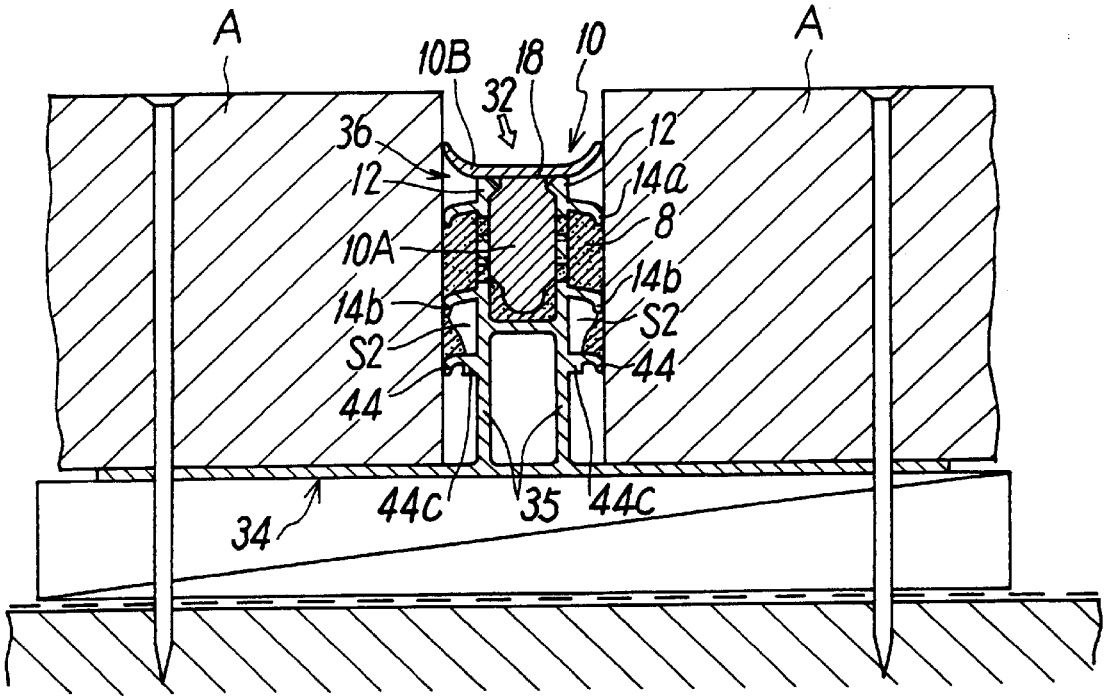
FIG. 8 is a sectional view showing a state of a joint member of a third embodiment in accordance with the present invention after installation.

FIG. 8 shows a third embodiment in accordance with the present invention. A joint member 32 of the third embodiment has a joint base member 36 made integral therewith via legs 35 arranged in a standing manner on the surface of a joiner 34 as shown in the drawing.

The joint base member 36 is used for a case wherein the wall surface facing members A are thick; it is not particular different in the configuration, the operations, and the installation methods from the first embodiment except for the legs 35 and sealing tongue flaps 44 provided on the legs 35. Hence, like reference numerals will be assigned to like or equivalent components, and the descriptions thereof will be omitted.

The sealing tongue flaps 44 are provided to form a space S2 between the sealing tongue flaps 14*b* in the first embodiment and the joiner 34 so as to prevent a sealant flowing into the space S2 from being dissipated. In this embodiment, a case is shown wherein the sealing tongue flaps 44 are provided with protuberances 44*c* for setting a minimum width of a joint groove. In the third embodiment also, a covering member 12 similar to that in the second embodiment can be used as a sealing member for a mouth portion 18 between the two side plates 12 and 12.

Figure 9:
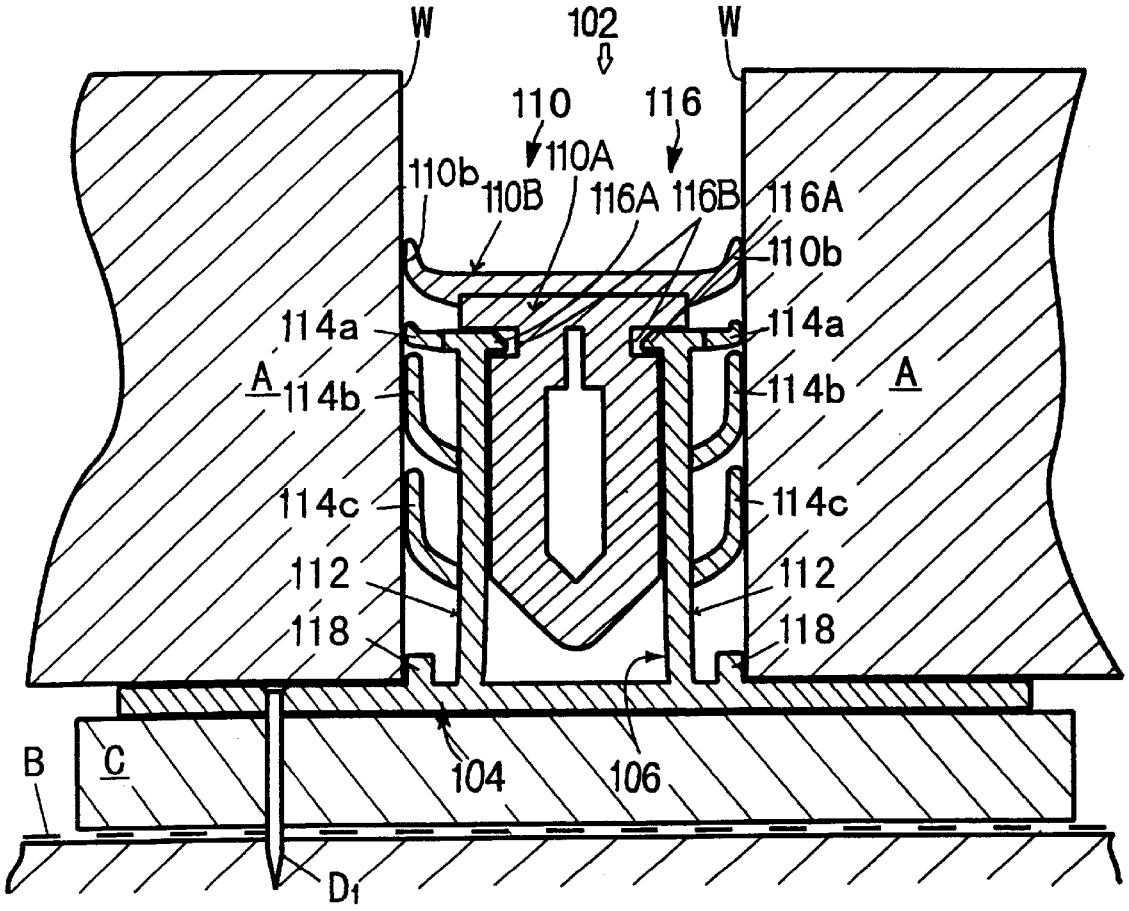
FIG. 9 is a sectional view showing a state of a joint member of a fourth embodiment in accordance with the present invention after installation.
Figure 10:
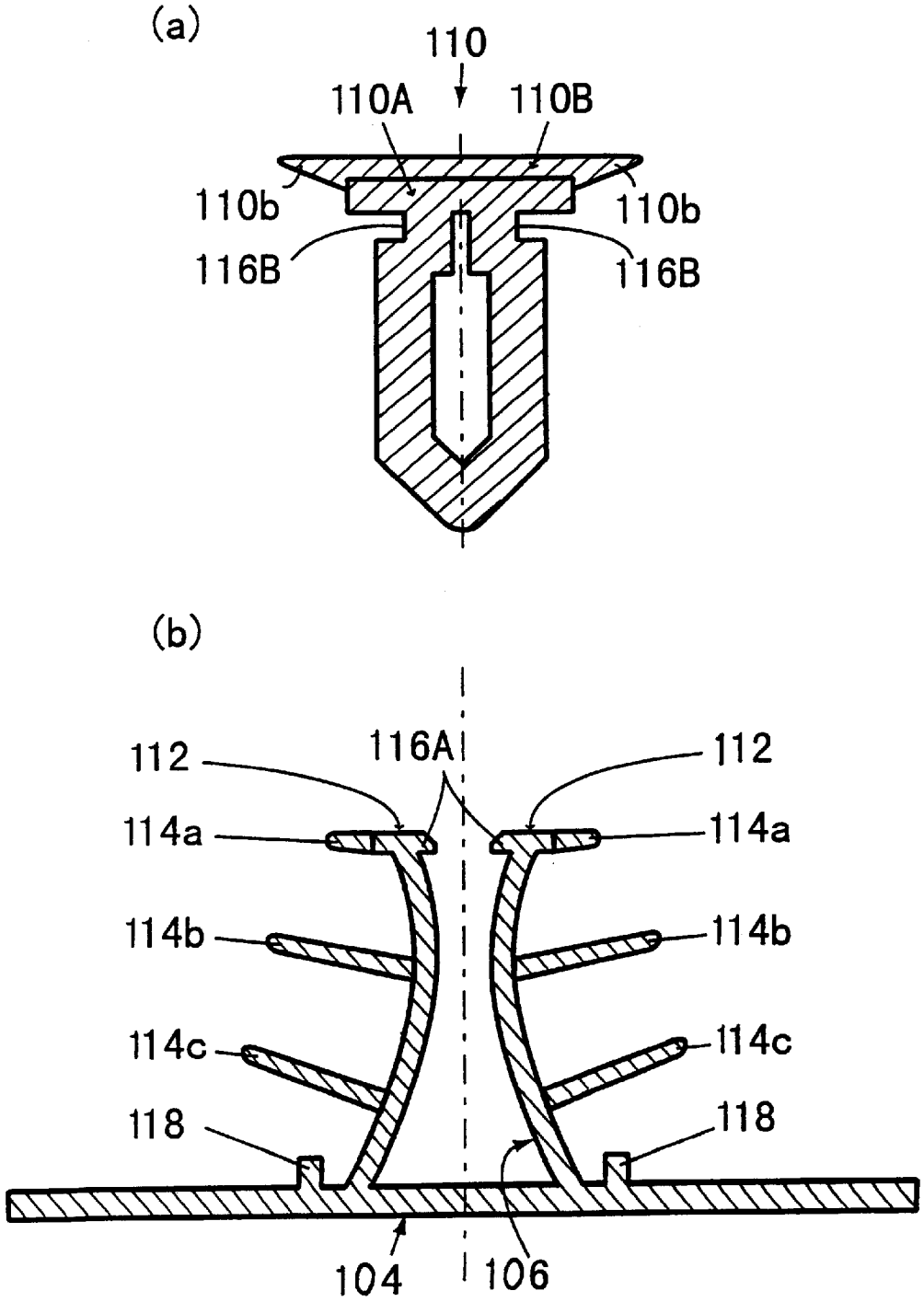
FIG. 10(*a*) is a sectional view of a core member in the joint member of a fourth embodiment, and (*b*) is a sectional view of a joiner made integral with a sealing structural member of the fourth embodiment.
Figure 11:
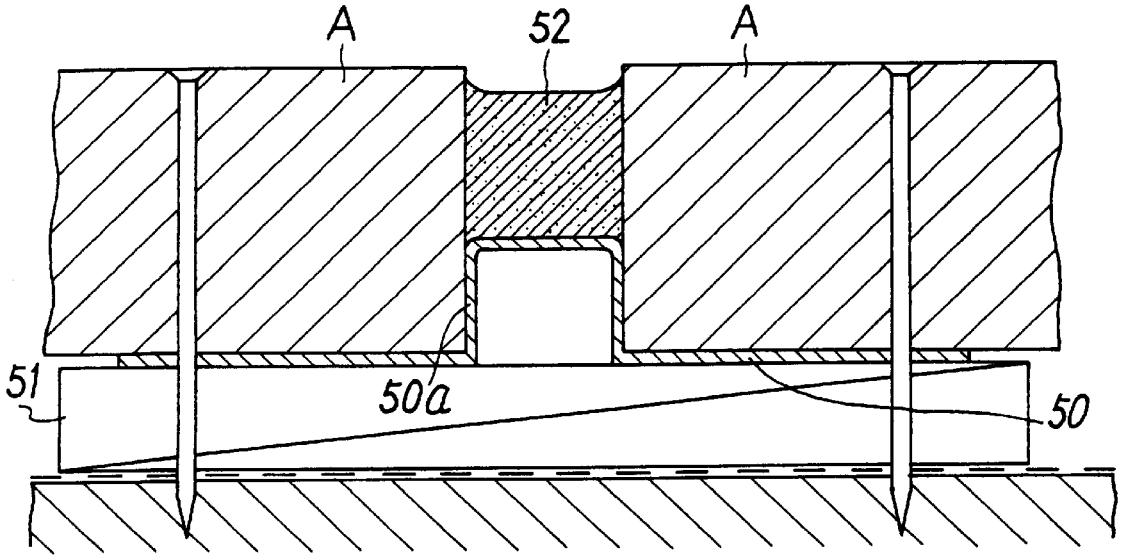
FIG. 11 is a sectional view showing a conventional example.

FIG. 9 and FIGS. 10(*a*) and (*b*) show a fourth embodiment of a joint member in accordance with the present invention.

In FIG. 9, reference numeral 102 denotes a joint member for sealing a joint groove at joined portion or the like of wall surface facing members (sidings or other facing panels) A of a building. The joint member 102 is used primarily for a joint groove required to secure water-tightness between adjoining wall surface facing members A in the building. The joint member 102 is schematically formed of a joiner 104, a sealing structural member 106 made integral with the joiner 104, and a core member 110.

As can be seen from FIG. 9, the joiner 104 is shaped like a tie plate positioned and provided between adjoining wall surface facing members A on a furring strip C. The furring strip C, which constitutes a bed surface of facing, is installed to a body of the building via a waterproof sheet B employed as necessary. The joiner 104 is fixed to the furring strip C by a nail $D_1$ or the like.

The sealing structural member 106 consecutively and integrally installed to the surface of the joiner 104 has its right and left side plates 112 and 112 made of a thermoplastic relatively hard synthetic resin consecutively and opposingly installed to the joiner 104 at their proximal ends, the side plates 112 and 112 being curved at their central portions in directions for narrowing a space therebetween into which the core member 110 is pushed as clearly shown in FIG. 10(*b*). Furthermore, three pairs of sealing tongue flaps 114*a*, 114*b*, and 114*c*, which are made of a thermoplastic soft synthetic resin, are protuberantly provided at top, bottom, and middle of outer side surfaces of the two side plates 112 such that they are formed integrally with the side plates 112. These sealing tongue flaps 114*a*, 114*b*, and 114*c* constitute a sealing assembly for sealing (secondary sealing) of a joint groove.

As shown in FIG. 9 and FIG. 10(*a*), the core member 110 is formed to have a substantially T-shaped section by integrally and consecutively installing a core portion 110A formed of a thermoplastic relatively hard synthetic resin with a hollow center and a head portion 110B that covers the mouth of the joint groove. A head portion 110B of the core member 110 has its both wings 110*b* in frictional contact with the inner walls W of the joint groove for sealing (primary sealing), and it is formed of a jaw plate made of a thermoplastic relatively soft synthetic resin that covers the mouth portion of the joint groove. The jaw plate of the head portion 110B is formed integrally with the top flat surface of the core portion 110A except for the portions on both ends thereof; therefore, when it is press-fitted in the joint groove, the portion made integral with the core portion 110A forms a flat surface, and only both end portions are firmly pressed into contact with the inner walls W of the joint groove, presenting a superb appearance.

Furthermore, engaging hooks 116A are provided at upper ends of the inner surfaces of the two side plates 112 in the sealing structural member 106 such that they oppose each other. In addition, engaging grooves 116B are formed in a depressed manner at proximal end portions of the core portion 110A where the core portion 110A and the head portion 110B are consecutively installed in the core member 110. Thus, as the core member 110 is pushed into the sealing structural member 106, the engaging hooks 116A and the engaging grooves 116B engage each other to form an engaging portion 116 that holds the core member 110 between the two side plates 112 in the sealing structural member 106 such that it does not slip off.

Reference numeral 118 in the drawing denotes projections that provide limitation in setting the width of a joint groove. A minimum width of a joint groove is restricted or a proper width thereof is set by abutting the end surfaces of the wall surface facing members A against the projections 118. The projections 118 may be omitted as necessary; however, they may be provided in the following embodiments.

To install the joint member 102 of the fourth embodiment in accordance with the present invention that has the configuration set forth above, first, the sealing structural member 106 is positioned between the wall surface facing members A to provide the joiner 104, and the wall surface facing members A are fixed in this state. Then, the core portion 110A of the core member 110 is pushed into a gap between the two side plates 112 and 112 of the sealing structural member 106. This causes the jaw plate of the head portion 110B of the core member 110 to provide the mouth portion of the joint groove with the primary sealing. At the same time, the two side plates 112 of the sealing structural member 106 are pushed and spread by the core member 110A to cause the sealing tongue flaps 114*a*, 114*b*, and 114*c* on the outer side surfaces of the side plates 112 to be pressed into contact with the inner walls W of the joint groove to perform the secondary sealing. Furthermore, the engaging projections 116A formed on the two side plates of the sealing structural member 106 and the engaging grooves 116B formed in the core portion 110A of the core member 110 engage with each other to hold the core member 110 between the two side plates 112 and 112 in the sealing structural member 106 such that it does not slip off. This arrangement makes it possible to securely maintain water-tightness and also to successfully cope with variations in the width of joint grooves.

Furthermore, the two side plates 112 and 112 are curved at their central portions in directions for narrowing the space into which the core member is pushed, and the core member 110 having both side surfaces of the core portion 110A substantially in parallel is pushed in the gap between the side plates 112 and 112. Hence, the sealing tongue flaps 114*a*, 114*b*, and 114*c* are not firmly pressed into contact with the end surfaces of the facing members when installing the joint member between the wall surface facing members so as not to interfere with working. When press-fitting the core member 110 into the gap between the side plates 112 and 112, the contact pressure of the respective sealing tongue flaps 114*a*, 114*b*, and 114*c* is successfully applied to the inner walls W of the joint groove, thus permitting good sealing effect to be achieved.

The joint member described above can be easily installed in a dry manner, without sacrificing an appearance, in a joint groove required to secure water-tightness between adjacent wall surface facing members A of a building. Moreover, since the joiner 104 itself is provided integrally with the sealing structural member 106 for easily sealing a joint groove, reliable sealing can be accomplished easily at low cost.

REFERENCE NUMERALS

2 Joint member
4 Joiner
6 Joint base member
8 Sealant
10 Core member
10A Core portion
10B Head portion
10*a* Distal end
10*b* Both wings
12 Side plates
14*a* Sealing tongue flap
145 Sealing tongue flap
14*c* Protuberance
16 Aperture
18 Mouth portion
20A Mold release sheet
20B Mold release sheet
22 Engaging portion
24 Engaging portion
26 Covering member
27 Core member
27A Core portion
27B Head portion
27*a* Protuberance
32 Joint member
34 Joiner
35 Leg
36 Joint base member
44 Sealing tongue flap
44*c* Protuberance
50 Joiner
51 Bed member
50*a* Both projecting side surfaces
52 Sealant
102 Joint member
104 Joiner
106 Sealing structural member
110 Core member
110A Core portion
110B Head portion
110*b* Wing
112 Side plates
114*a* Sealing tongue flap
114*b* Sealing tongue flap
114*c* Sealing tongue flap
116 Engaging portion
116A Engaging hook
116B Engaging groove
28 Engaging portion
A Wall surface facing member
B Waterproof sheet
C Furring strip
D Nail
$D_1$ Nail
S1 Space
S2 Space
S3 Sealant charge area
W Inner wall
118 Projection

What is claimed is:

1. A joint member comprising:

a joint base member integrally installed on a surface of a synthetic resin joiner provided between wall surface facing members on a bed surface of a building facing, wherein:

said joint base member comprises right and left side plates, at least two soft sealing tongue flaps protuberantly provided on outer side surfaces of said side plates, distal ends thereof contacting end surfaces of the wall surface facing members of a joint groove, and numerous apertures drilled between said sealing tongue flaps in said side plates;

a sufficient amount of sealant configured to fill a space between the side plates, which is sufficient to seal a space surrounded by a pair of sealing tongue flaps and the inner side walls of the joint groove, charged between the side plates of said joint base member, and a sealing member for restraining outflow of the sealant attached to a mouth portion between the side plates of said joint base member; and a core member pushed between the side plates of said joint base member formed of a core portion configured to press out the sealant, which has been charged by being pushed into the space between said side plates, through the apertures of said side plates, and a jaw plate of a head portion covering a joint groove mouth portion, said core portion and said jaw plate comprising a substantially T-shaped section, and said core portion does not reach a bottom part of a sealant charge area between said sides plates.

2. A joint member comprising:

a joint base member integrally installed on a surface of a synthetic resin joiner provided between wall surface facing members on a bed surface of a building facing, wherein:

said joint base member comprises right and left side plates, at least two soft sealing tongue flaps protuberantly provided on outer side surfaces of said side plates, distal ends thereof contacting end surfaces of the wall surface facing members of a joint groove, and numerous apertures drilled between said sealing tongue flaps in said side plates;

a sufficient amount of sealant configured to fill a space between the side plates, which is sufficient to seal a space surrounded by a pair of sealing tongue flaps and the inner side walls of the joint groove, is charged between the side plates of said joint base member, and a covering member configured to restrain outflow of the sealant and configured to restrain a mouth portion between the side plates from narrowing is fitted into the mouth portion; and a core member pushed between the side plates of said joint base member formed of a core portion configured to push between said side plates while pressing the covering member so as to press out the sealant, which has been charged therein, through the apertures of said side plates, and a jaw plate of a head portion covering a joint groove mouth portion, said core portion and said jaw plate comprising a substantially T-shaped section, and said core portion not causing a distal end of the covering member to reach a bottom part of a sealant charge area between said sides plates.

3. A joint member according to claim 1, wherein a space into which the remainder of a sealant, which is pressed into the space surrounded by the pair of sealing tongue flaps and the inner walls of the joint groove when the core member is pushed into the gap between the side plates, flows is formed between sealing tongue flaps on a joiner side in the side plates of the joint base member and the joiner.

4. A joint member according to claim 1 or 2, wherein protuberances located on outer side surfaces of the side plates configured to set a minimum width of the joint groove are formed on proximal ends of at least one set of sealing tongue flaps at opposing positions of the side plates.

5. An installation method for installing the joint member according to claim 1, comprising:

providing a joiner by positioning a joint base member between wall surface facing members on a bed surface of a building facing; and pushing a core portion of a core member into a gap between the side plates of the joint base member filled with a sealant to push said sealant into a space surrounded by a pair of sealing tongue flaps protuberantly provided on outer side surfaces of said side plates and inner walls of a joint groove through apertures of the side plates, and covering a mouth portion of the joint groove by a jaw plate of a core member head portion.

6. An installation method for installing the joint member according to claim 2, comprising:

providing a joiner by positioning a joint base member between wall surface facing members on a bed surface of a building facing; and pushing a core portion of a core member into a gap between the side plates of the joint base member filled with a sealant while pushing a covering member, which has been fitted into a mouth portion between the two side plates, so as to push said sealant into a space surrounded by a pair of sealing tongue flaps protuberantly provided on outer side surfaces of said side plates and inner walls of a joint groove through apertures of the side plates, and for covering a mouth portion of the joint groove by a jaw plate of a core member head portion.

7. A joint member according to claim 2, wherein a space into which the remainder of a sealant, which is pressed into the space surrounded by the pair of sealing tongue flaps and the inner walls of the joint groove when the core member is pushed into the gap between the side plates, flows is formed between sealing tongue flaps on a joiner side in the side plates of the joint base member and the joiner.

8. A joint member according to claim 2, wherein protuberances for setting a minimum width of the joint groove are formed on proximal ends of at least one set of sealing tongue flaps at opposing positions of the two side plates, the protuberances being located on outer side surfaces of the two side plates in the joint base member.

* * * * *